US008714147B2

(12) United States Patent
Walk et al.

(10) Patent No.: US 8,714,147 B2
(45) Date of Patent: May 6, 2014

(54) MODULAR QUIVER APPARATUS AND METHOD

(75) Inventors: Randy J. Walk, Erda, UT (US); Don Wasilewski, Stansbury Park, UT (US); Zak T. Kurtzhals, Herriman, UT (US)

(73) Assignee: Hoyt Archery, Inc., Salt Lake City, UT (US)

( * ) Notice: Subject to any disclaimer, the term of this patent is extended or adjusted under 35 U.S.C. 154(b) by 181 days.

(21) Appl. No.: 13/343,641

(22) Filed: Jan. 4, 2012

(65) Prior Publication Data

US 2013/0167822 A1 Jul. 4, 2013

(51) Int. Cl.
*F41B 5/06* (2006.01)

(52) U.S. Cl.
USPC ..... 124/86; 224/916

(58) Field of Classification Search
USPC ..... 124/25.5, 25.7, 86; 224/916
See application file for complete search history.

(56) References Cited

U.S. PATENT DOCUMENTS

| | | | | |
|---|---|---|---|---|
| 6,105,566 | A * | 8/2000 | Tiedemann | 124/86 |
| 6,390,085 | B1 * | 5/2002 | Stinson | 124/86 |
| 6,672,299 | B2 * | 1/2004 | Proctor | 124/86 |
| 7,367,331 | B1 * | 5/2008 | Horinek | 124/86 |

* cited by examiner

*Primary Examiner* — John Ricci
(74) *Attorney, Agent, or Firm* — Holland & Hart

(57) ABSTRACT

An arrow quiver includes a base member, a bow attachment member configured to mount the base member to an archery bow, at least one arrow mounting assembly, and a hood assembly. The at least one arrow mounting assembly includes a first arrow mounting portion mounted to the base member and configured to retain a first plurality of arrows, and a second arrow mounting portion releasably mounted to the first arrow mounting portion and configured to retain a second plurality of arrows. The hood assembly is mounted to the base member and configured to at least partially hood arrow points of the plurality of arrows retained by the at least one arrow mounting assembly.

18 Claims, 8 Drawing Sheets

MODULAR QUIVER APPARATUS AND METHOD

TECHNICAL FIELD

The present disclosure is directed to archery bows accessories, and more particularly to arrow quivers for archery bows.

BACKGROUND

An arrow quiver is used to hold extra arrows. In some hunting applications it may be desirable to have a quiver mounted to the bow to provide quick and convenient access to the extra arrows. Other desirable features for quivers used in hunting applications may include lightweight, proper balance, quiet, and quickly disconnectable from the bow.

Some types of quivers may be attached to the side of a riser of the bow and may include a releasable attachment device. The quiver may be arranged such that when the bowstring is released when launching an arrow, the bow and quiver assembly have an optimum mass distribution that is dynamically balanced to minimize vibration and torque forces acting on the bow when an arrow is launched, thus improving accuracy and shooting comfort.

Some types of quivers include a plurality of arrow-holding members, such as grippers, slots, and pockets, that individually mount each arrow to the quiver. The arrow-holding members may contact the arrows at spaced apart locations along the length of the arrows. The quiver may also include a cover member or hood to protect the arrow points (e.g., broadheads, field points, judo points, etc.) from being damaged or dulled and protect people and objects from being injured or damaged by the arrow points. The quiver may also include a mounting bracket for mounting the quiver to a bow and adjusting a position of the quiver relative to the bow.

The holding capacity of traditional quivers has traditionally been sized to hold a predetermined and fixed number of arrows. The number of arrows needed or desired by a user of the bow may vary significantly depending on the intended use or application of the archery bow (e.g., backcountry hunting, treestand hunting, target practice, etc.). The desired size of the arrow quiver when hunting may be affected by the skill of the archer. Typically, a user must select among a plurality of quivers for one that is capable of holding the desired number of arrows. The archer may be required to purchase multiple quivers having different capacities.

Opportunities exist for improvements in quivers used in association with archery bows.

SUMMARY

One aspect of the present disclosure relates to an arrow quiver that includes a base member, a bow attachment member configured to mount the base member to an archery bow, and at least one arrow mounting assembly. The at least one arrow mounting assembly includes a first arrow mounting portion mounted to the base member and configured to retain a first plurality of arrows, and a second arrow mounting portion releasably mounted to the first arrow mounting portion and configured to retain a second plurality of arrows.

The first arrow mounting portion may retain at least three arrows, and the second arrow mounting portion may retain at least two arrows. The arrow quiver may include first and second arrow mounting assemblies that separately mount to the base member, and each includes a first arrow mounting portion mounted to the base member configured to retain a first plurality of arrows, and a second arrow mounting portion releasably mounted to the first arrow mounting portion and configured to retain a second plurality of arrows.

The arrow quiver may further include a hood assembly mounted to the base member and configured to at least partially hood arrow points of the plurality of arrows retained by the at least one arrow mounting assembly. The hood assembly may include a first hood portion mounted to the base member and configured to at least partially house the arrow points of the first plurality of arrows, and a second hood portion releasably mounted to the first hood portion and configured to at least partially house the arrow points of the second plurality of arrows. The hood assembly may further include a hood end cap mountable to the first hood portion in place of the second hood portion.

The base member may include an elongate shaft, the hood assembly being mounted to a first end of the elongate shaft, and the at least one arrow mounting assembly being mounted to a second end of the elongate shaft. The bow attachment member may be mounted to the elongate shaft at a location spaced between the at least one arrow mounting assembly and the hood assembly. The second arrow mounting portion may include at least one resilient arrow retaining member and an attachment extension, wherein the attachment extension is configured to connect the second arrow mounting portion to the first arrow mounting portion. The first and second hood portions may connect together with a sliding lock.

Another aspect of the present disclosure relates to an arrow quiver that includes at least one arrow mounting assembly and a base portion. The at least one arrow mounting assembly has a first configuration for holding a first maximum number of arrows, and a second configuration for holding a second maximum number of arrows. The base portion is configured to releasably mount the at least one arrow mounting assembly to an archery bow.

The arrow quiver may also include a hood assembly configured to house end portions of arrows held by the at least one arrow mounting assembly. The hood assembly may have a first configuration for housing a first maximum number of arrow end portions of the first maximum number of arrows, and a second configuration for housing a second maximum number of arrow end portions second maximum number of arrows. The first maximum number of arrows may be no more than three, and the second maximum number of arrows may be no more than six. The at least one arrow mounting assembly includes first and second arrow mounting assemblies that each include a first configuration for holding a first maximum number of arrows, and a second configuration for holding a second maximum number of arrows.

A further aspect of the present disclosure relates to a method of mounting arrows to an archery bow. The method includes providing an arrow quiver that includes at least one arrow mounting assembly including first and second arrow attachment portions each configured to retain a plurality of arrows, mounting the at least one arrow mounting assembly to the archery bow, mounting a first plurality of arrows to the first arrow attachment portion, mounting the second arrow attachment portion to the first arrow attachment portion, and mounting a second plurality of arrows to the second arrow attachment portion.

Each of the first plurality of arrows may be individually mounted to the first arrow attachment portion, and each of the second plurality of arrows may be individually mounted to the second arrow attachment portion. The method may also include providing a hood assembly that includes first and second hood portions releasably connected together, wherein the first hood portion is sized to hood arrow points of the first plurality of arrows, and the second hood portion is sized to hood arrow points of the second plurality of arrows.

The hood assembly may also include a hood end cap releasably connected to the first hood portion in place of the second hood portion. Each of the first and second arrow attachment portions may include a plurality of resilient arrow retaining members configured to individually mount at least one arrow. The method may include providing a base member and an attachment assembly, connecting the at least one arrow mounting assembly to the base member, and mounting the base member to the archery bow with the attachment assembly.

The foregoing and other features, utilities, and advantages of the subject matter described herein will be apparent from the following more particular description of certain embodiments as illustrated in the accompanying drawings.

DETAILED DESCRIPTION

Figure 1:
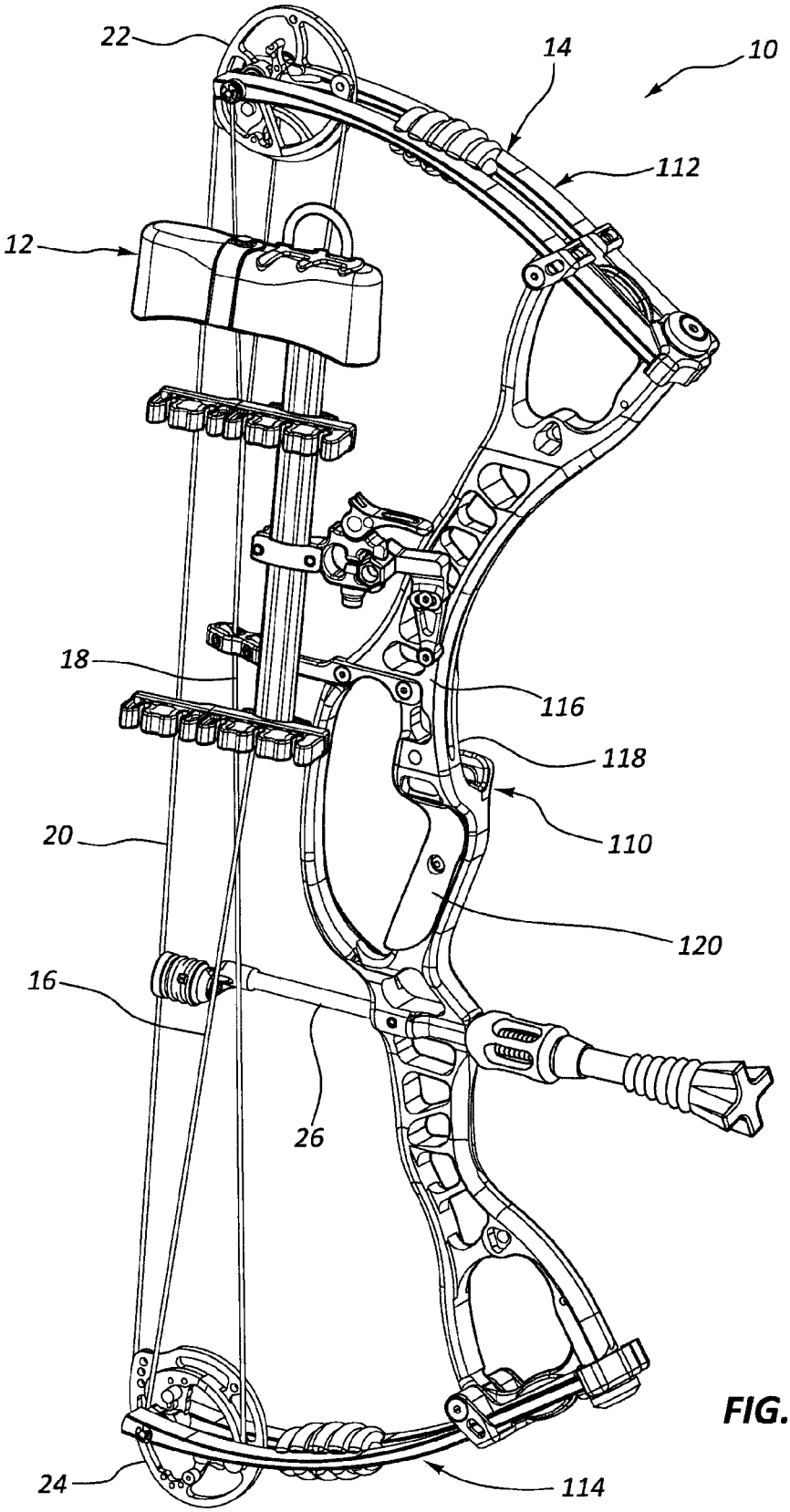
FIG. 1 is a perspective view of an archery bow having an example quiver assembly in accordance with the present disclosure.

Reference is made in the following to a number of illustrative embodiments of the subject matter described herein. The following embodiments illustrate only a few selected embodiments that may include the various features, characteristics, and advantages of the subject matter as presently described. Accordingly, the following embodiments should not be considered as being comprehensive of all of the possible embodiments. Also, features and characteristics of one embodiment may and should be interpreted to equally apply to other embodiments or be used in combination with any number of other features from the various embodiments to provide further additional embodiments, which may describe subject matter having a scope that varies (e.g., broader, etc.) from the particular embodiments explained below. Accordingly, any combination of any of the subject matter described herein is contemplated.

The present disclosure is directed to an arrow quiver for holding a plurality of archery arrows. Some aspects of the present disclosure may be directed specifically to a quiver that is removably securable to an archery bow. Generally, the quiver assembly may be configured to hold a plurality of arrows, with each arrow being held separately from the others. Each arrow may be removed independent of the other arrows for use.

One aspect of the present disclosure relates to a quiver assembly that is modular in nature so that it may be configured to accommodate varying numbers of arrows. The modular quiver may be modified to change the carrying capacity of the quiver. For example, the quiver assembly may, in one configuration, be modified to hold a first number of arrows in the range of about 1 to about 3 arrows. In a second configuration, the quiver assembly may be configured to hold a second number of arrows in the range of about 2 to about 6 arrows. In one example, the quiver assembly may include a first or primary arrow mounting configuration that holds up to a first number of arrows. The arrow assembly may be modified by adding another modular component to increase the arrow carrying capacity to carry one or more additional arrows than in the primary or first configuration.

The quiver assembly may include a modular arrow mounting assembly. The modular arrow mounting assembly may include at least first and second arrow mounting assemblies that are detachable from each other. The quiver assembly may also include a modular hood assembly. The modular hood assembly may include at least first and second hood portions that when connected to each other provide arrow point hooding capacity that is greater than either one of the hood portions used individually.

The quiver assembly may include a base member and an attachment assembly used to mount the quiver assembly to a riser of an archery bow. A first arrow mounting assembly may be connected to the base member, and the base member is connected to the riser of the archery bow using the attachment assembly. A second arrow mounting assembly may be connected to the first arrow mounting assembly to increase an arrow carrying capacity of the quiver assembly.

A first hood portion of the hood assembly may also be attached to the base member. A second hood portion of the hood assembly may be attached to the first hood portion to increase the arrow point hood capacity of the hood assembly. The hood assembly may also include a cap or end piece that is mounted to the first hood portion in place of the second hood portion. The hood assembly and arrow mounting assemblies may each be configured to accommodate any desired number of arrows.

Figure 3:
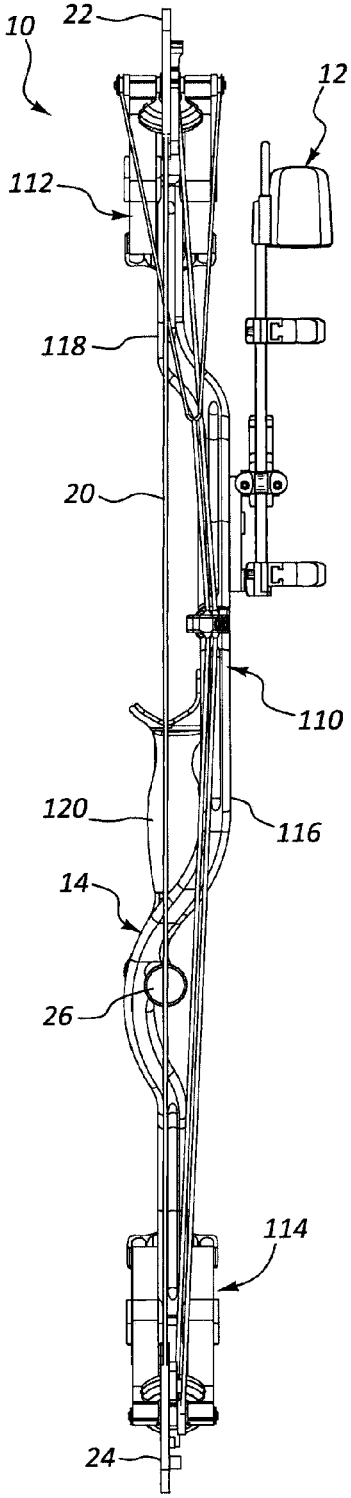
FIG. 3 is a rear view of the archery bow of FIG. 1.
Figure 2:
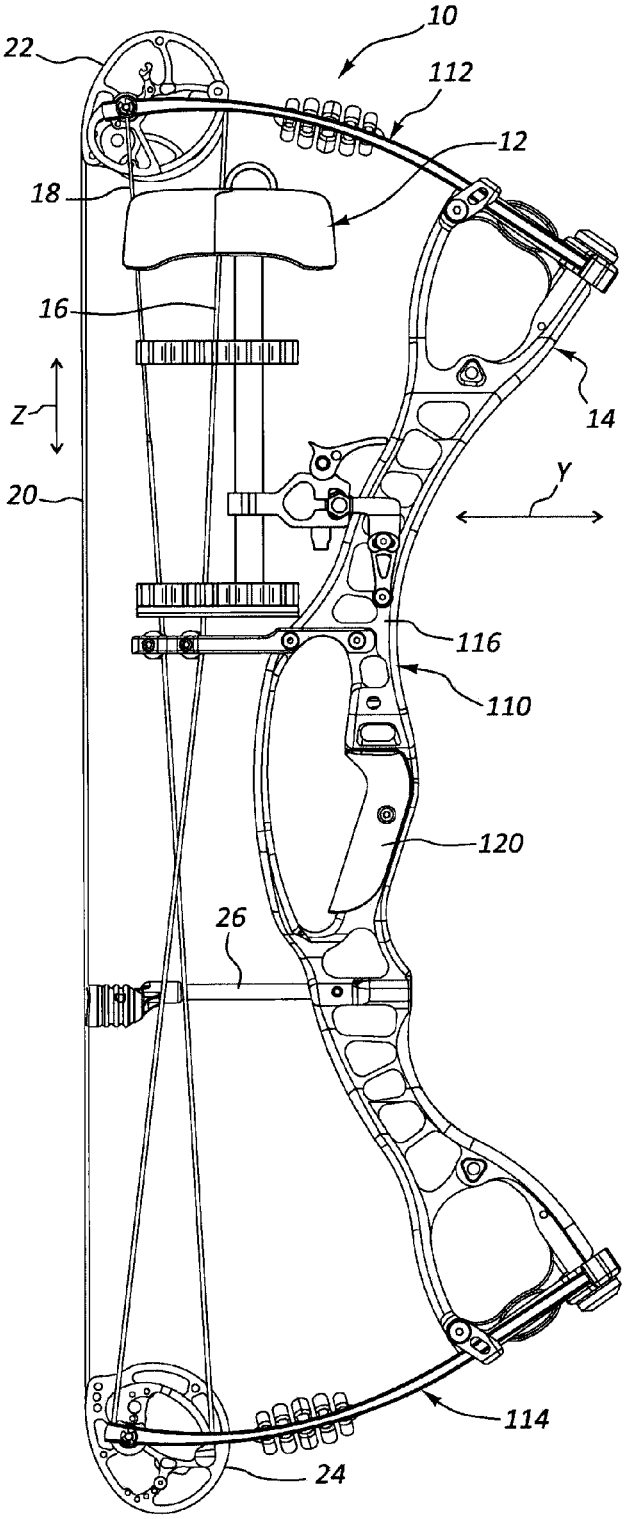
FIG. 2 is a right side view of the archery bow of FIG. 1.

Referring now to FIGS. 1-3, an archery bow 10 is shown including a quiver assembly 12, a riser 14, first and second cables 16, 18, a bowstring 20, first and second pulleys 22, 24, and a bowstring stop 26. The archery bow 10 may be a compound bow. The archery bow 10 is merely exemplary of one of many types of archery bows with which the quiver assembly 12 may be used. Typically, the quiver assembly 12 is mounted to the riser 14. In other configurations, the quiver assembly 12 may be used independent of an archery bow 10 and may be mounted to other structures or be a free-standing device.

The riser 14 includes a hand grip 120, upper and lower limbs 112, 114, and right and left side surfaces 116, 118. FIGS. 1-3 show the quiver assembly 12 mounted to the right side surface 116 of the riser 14 at a location above a hand grip 120. The quiver assembly 12 is configured with a single attachment point to the riser 14. Many other configurations are possible for the quiver assembly 12 including those that may attach to the riser 14 at multiple locations.

Figure 4:
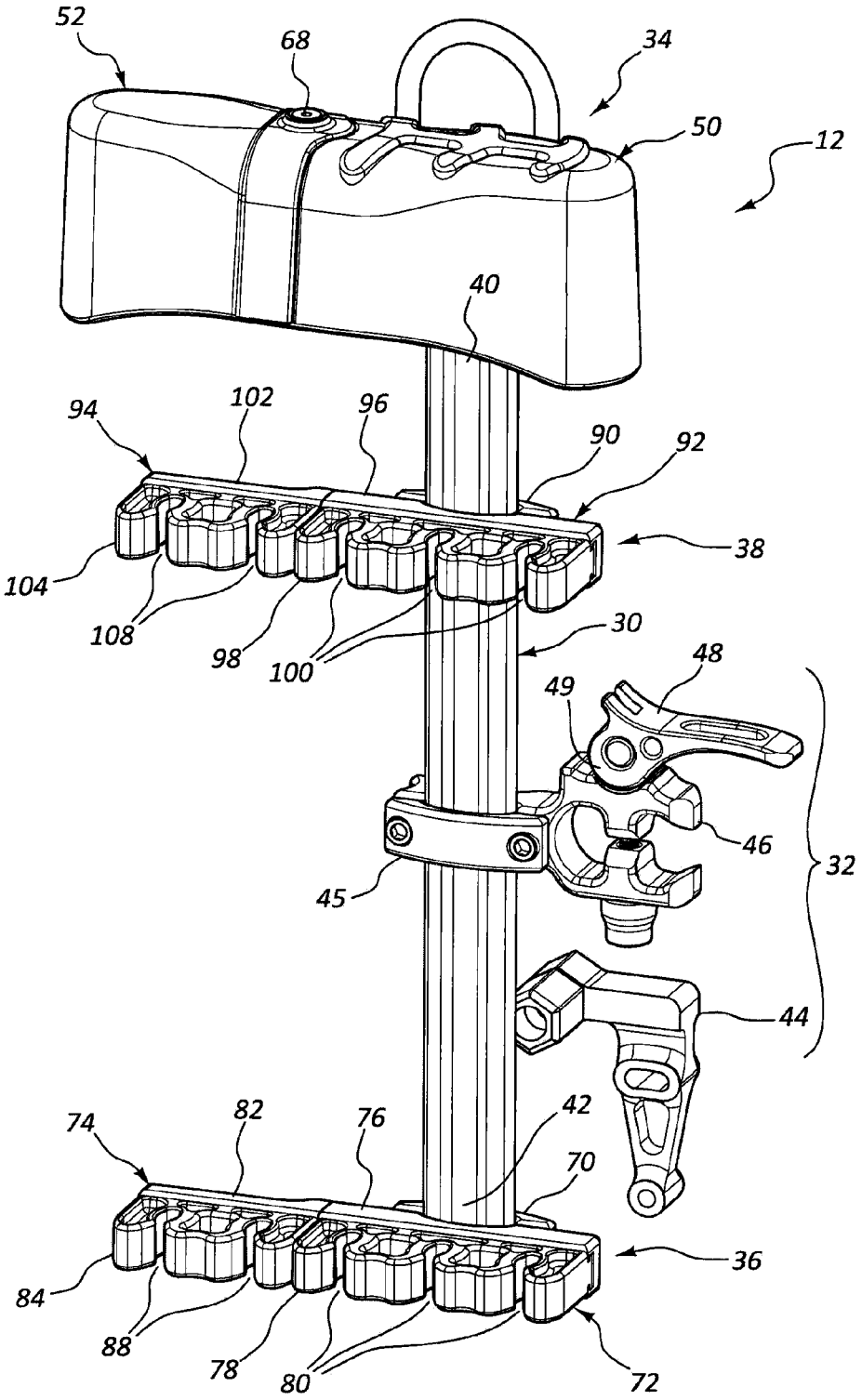
FIG. 4 is a perspective view of the quiver assembly of FIG. 1.
Figure 5:
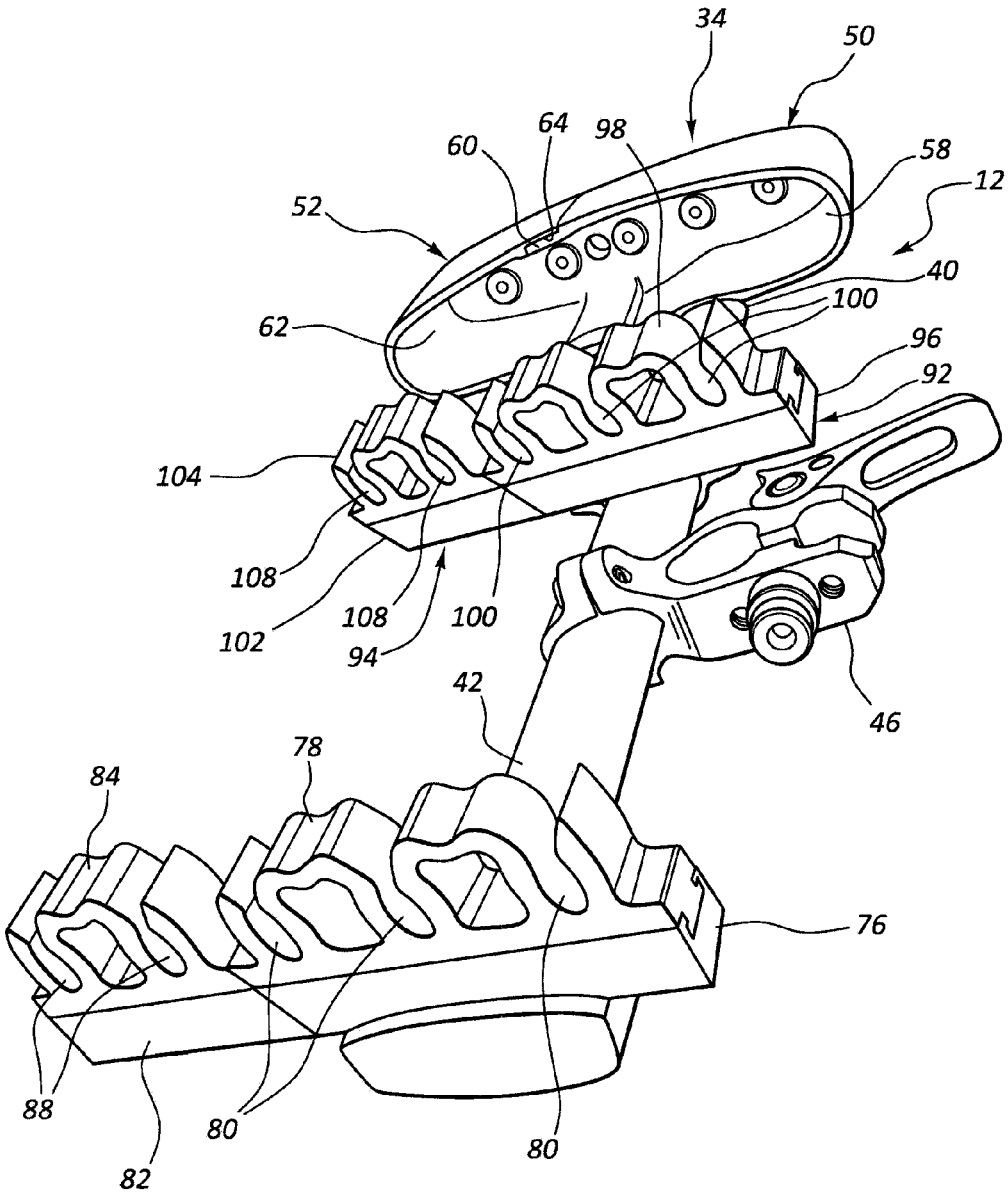
FIG. 5 is another perspective view of the quiver assembly of FIG. 1.
Figure 6:
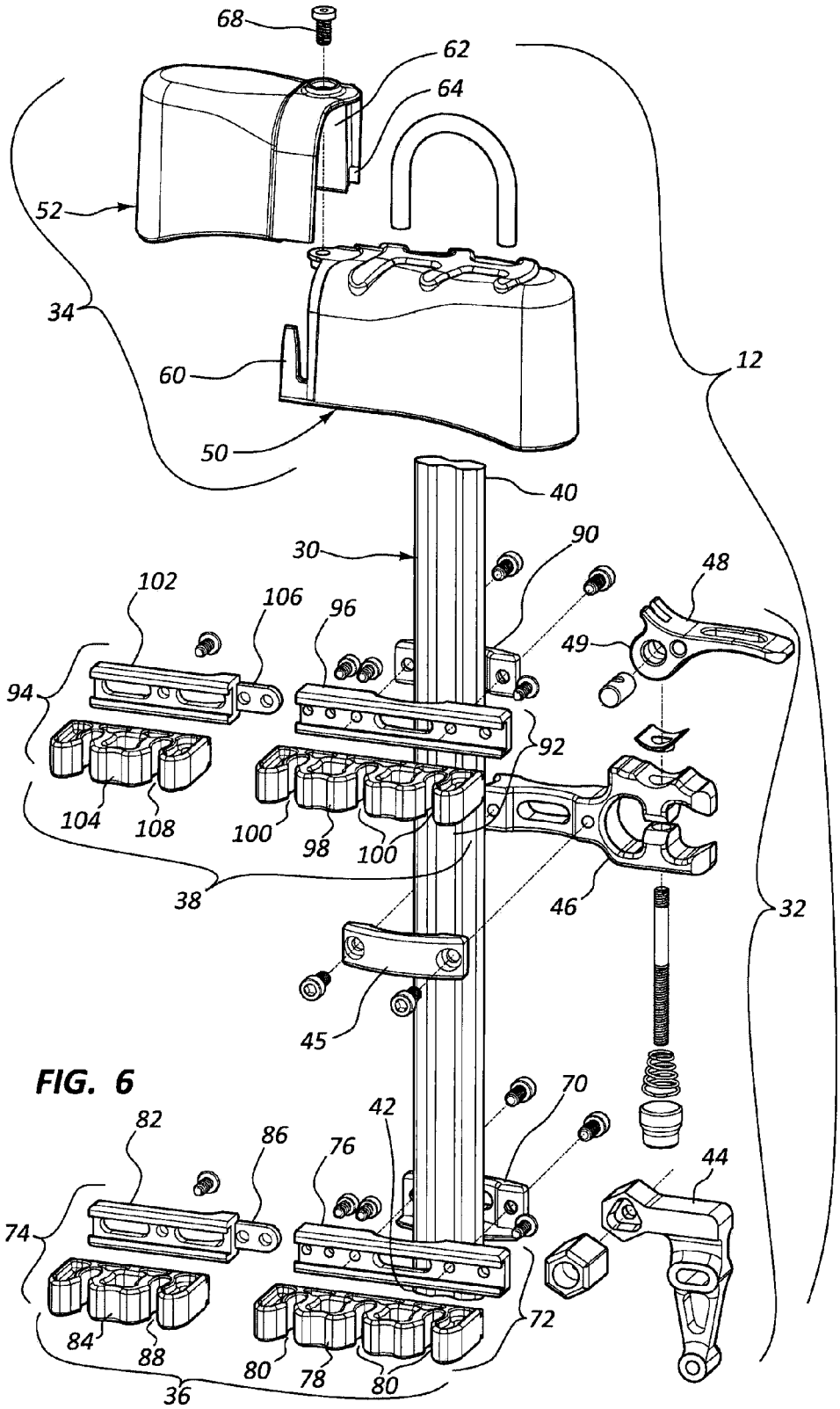
FIG. 6 is an exploded perspective view of the quiver assembly of FIG. 1.

Referring now to FIGS. 4-6, the quiver assembly 12 includes a base member 30, an attachment assembly 32, a hood assembly 34, and first and second arrow mounting assemblies 36, 38. The base member 30 may include an elongate rod having first and second ends 40, 42. In one example, the base number 30 comprises, for example, a composite material or a polymer material. Many other types of materials and constructions may be used for the base member 30. For example, the base member 30 may comprise a plurality of segments that are interconnected or mounted separately to the riser 14 of the archery bow 10.

The attachment assembly 32 may include a bow attachment portion 44, a base attachment portion 46, and a tightening mechanism 48. The bow attachment portion 44 may be configured to attach at any desired location along the riser 14. The bow attachment portion 44 may include a spacer or extension that helps space the attachment assembly 32 away from the riser 14 to space the quiver assembly 12 from the riser 14.

The base attachment portion 46 may include a base bracket 45 to connect the base attachment portion 46 to the base member 30. The tightening mechanism 48 may be used to secure the base attachment portion 46 to the bow attachment portion 44. The tightening mechanism 48 may comprise, for example, a cam lock member 49 or any other suitable structure that provides a quick release and adjustability in tension applied by the base attachment portion 46 to the bow attachment portion 44.

Figure 8:
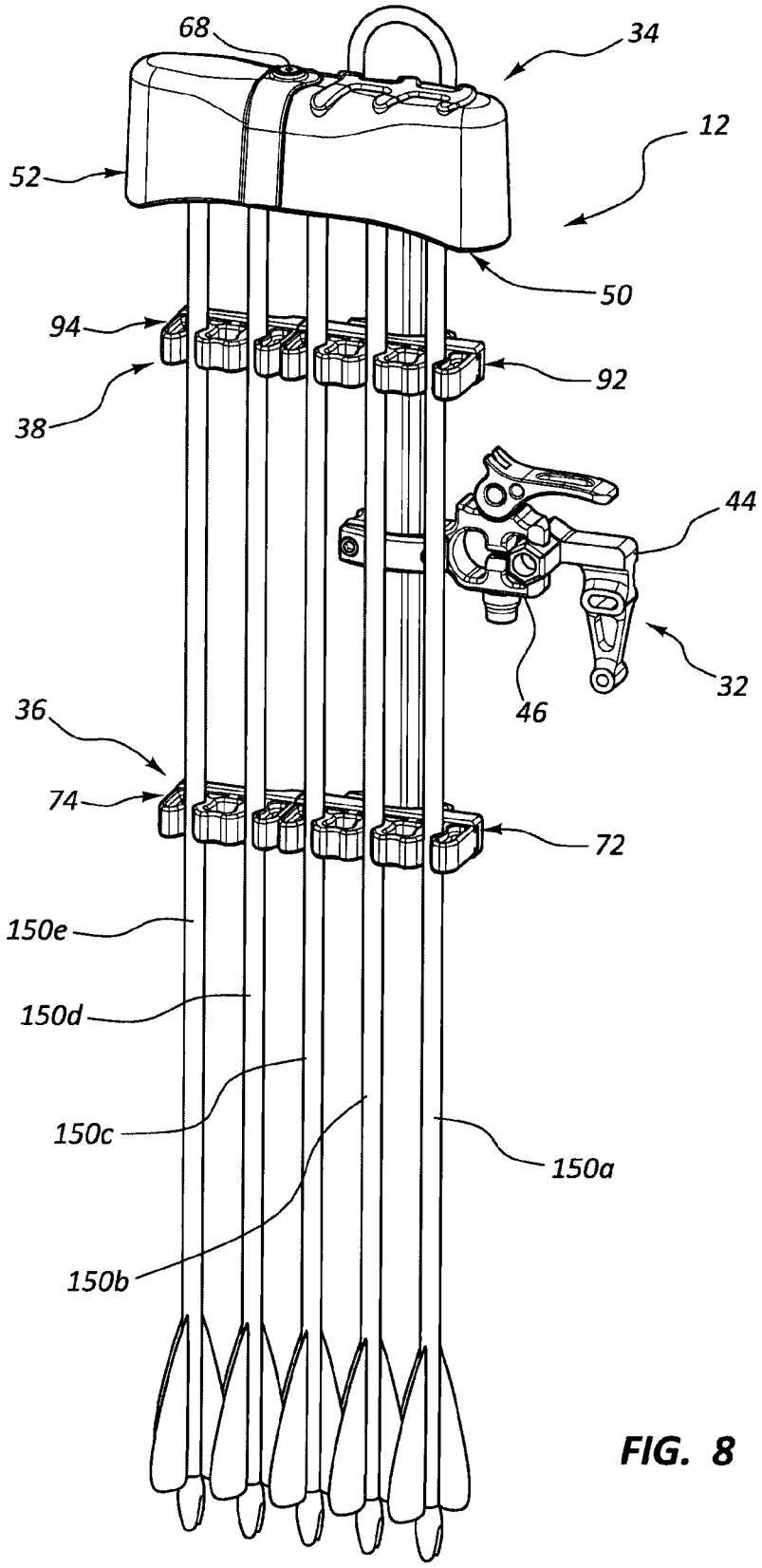
FIG. 8 is a perspective view of the quiver assembly of FIG. 1 in a first configuration having a first plurality of arrows mounted thereto.
Figure 9:
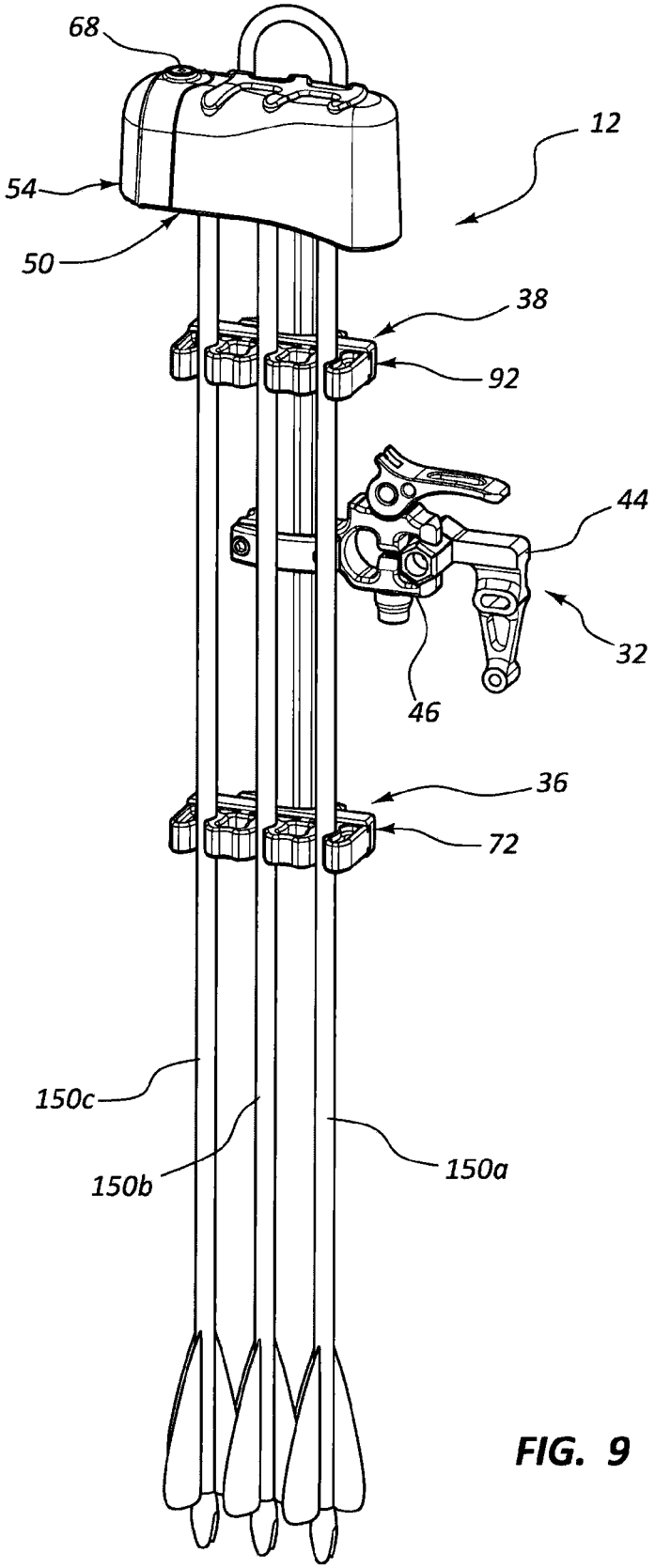
FIG. 9 is a perspective view of the quiver assembly of FIG. 7 in a second configuration with a second plurality of arrows mounted thereto.

The hood assembly 34 (see FIGS. 4-5) is modular in construction to vary the arrow covering and carrying capacity of the quiver assembly 12. The hood assembly 34 may include a first hood portion 50, a second hood portion 52, and a hood end cap 54 (see FIG. 7). The first hood portion 50 is mounted at the first end 40 of the base member 30. The second hood portion 52 is releasably connected to the first hood portion 50. The hood end cap 54 may be mounted to the first hood portion 50 in place of the second hood portion 52. The hood end cap 54 may provide an end surface for the first hood portion 50. Using the second hood portion 52 with the first hood portion 50 may provide an increased maximum arrow point covering capacity. Removing the second hood portion 52 and connecting the hood end cap 54 to the first hood portion 50 may provide a limited or reduced maximum arrow point covering capacity (e.g., compare arrow carrying capacity of configurations shown in FIGS. 8 and 9).

The first hood portion 50 includes a base connection portion 56 (see FIG. 3), a first arrow point cavity 58, and a pair of connector members 60 (see FIGS. 5-6). The base connection portion 56 may include a cavity or recess within which the first end 40 of the base member 30 extends to provide connection with the first hood portion 50. The first end 40 of the base member 30 may have an interference fit within the base connection portion 56. Other connection structures are possible including, for example, brackets, fasteners, welding, and adhesives.

The first arrow point cavity 58 may be accessed along a bottom side of the hood assembly 34 so that arrow points of the arrows carried by the first arrow mounting assembly 36 extend within the first hood portion 50 to be at least partially covered by the first hood portion 50. Typically, the first arrow point cavity 58 has width, depth and length dimensions that provide covering of a plurality of arrow point sizes for those arrows that may be carried by the first arrow mounting assembly 36. Some example arrow points include field points and broadhead points.

The connector members 60 provide a releasable attachment of the second hood portion 52 to the first hood portion 50. The connector members 60 may be arranged extending vertically upward when the quiver assembly 12 is in an upright position as shown in FIGS. 4-5. The connector members 60 may comprise, for example, snap-fit features (not shown) or other connecting features that provide releasable connection of the second hood portion 52 or the hood end cap 54 to the first hood portion 50. The connector member 60 may have a cantilever construction. The connector members 60 may comprise a taper structure along their length. In other arrangements, the connector members 60 may extend in different directions and have any desired construction, or may be eliminated altogether and replaced with other types of connectors and connection features that provide the desired releasable connection of the modular components of the hood assembly 34.

The second hood portion 52 includes a second arrow point cavity 62 and a pair of connector apertures 64 (see FIGS. 5-6). The second arrow point cavity 62 may be aligned and continuous with the first arrow point cavity 58 when the first and second hood portions 50, 52 are connected together. In some arrangements, the second arrow point cavity 62 is substantially the same size and shape as the first arrow point cavity 58. Many sizes and shapes are possible for the second arrow point cavity 62 to provide the desired arrow point covering capacity for those arrows carried by, for example, the second arrow mounting assembly 38.

In some arrangements, the hood assembly 34 has a single-piece design that may accommodate arrow points for any possible number of arrows carried by the first and second arrow mounting assemblies 36, 38. In still further arrangements, the hood assembly 34 may include the capability to add two or more hood portions to the first hood portion 50 to extend the arrow point covering capacity of the hood assembly even further than that shown in the figures. Each of the second, third and further hood portions may be open at opposite ends, with one open end being attached to the first hood portion and the opposite open end being covered or enclosed by the hood end cap 54.

The connector aperture 64 of the second hood portion 52 may be sized and arranged to receive the connector member 60 to provide a releasable connection between the first and second hood portion 50, 52. The connector aperture 64 may be open along a bottom side of the second hood portion 52. The connector apertures 64 may have a tapered construction along their length that substantially matches a tapered construction of the connector members 60. Typically, the connector apertures 64 are aligned to interface with the connector member 60 of the first hood portion 50 and whatever orientation, size or shape is provided for the connector member 60.

Figure 7:
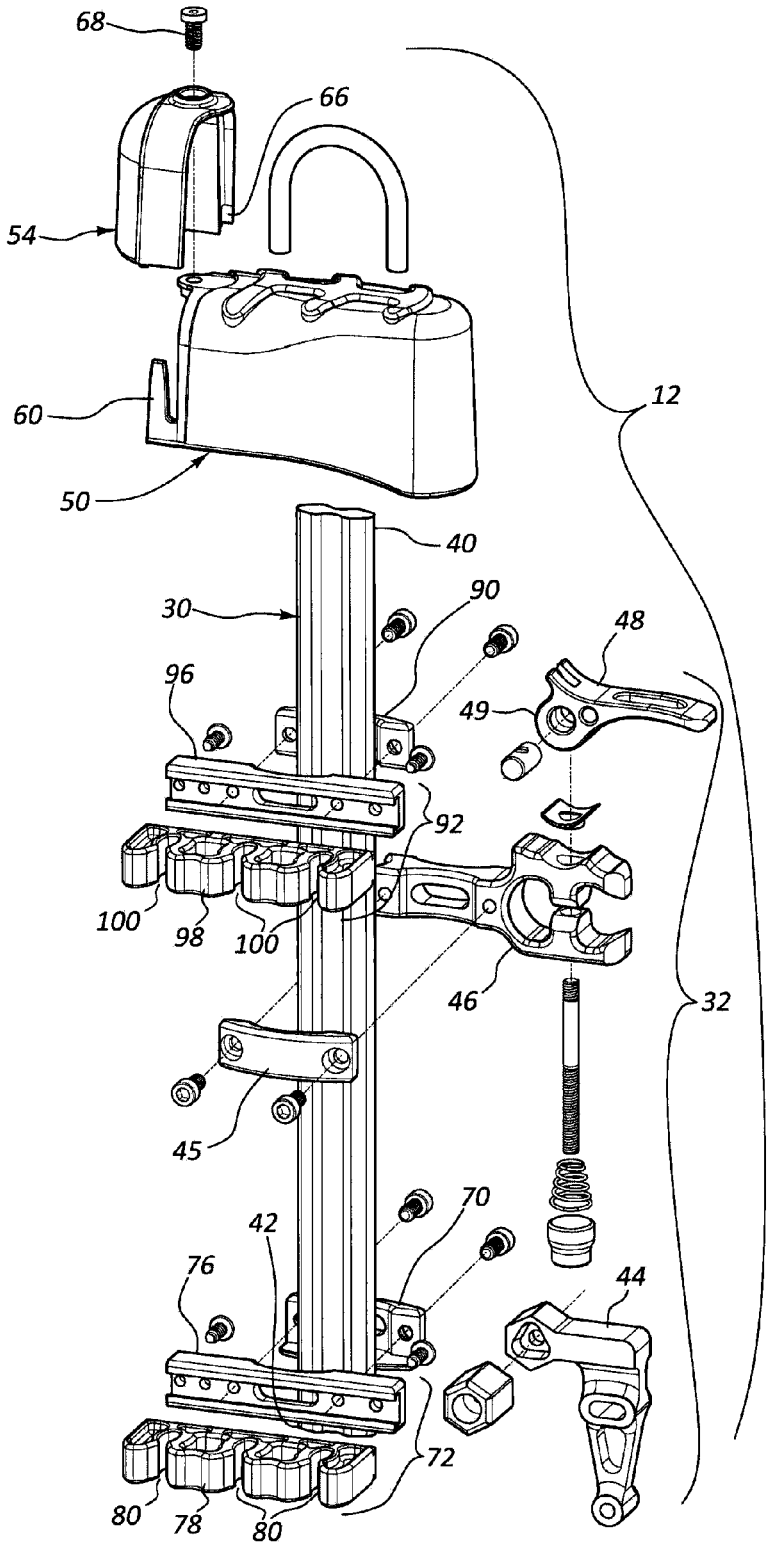
FIG. 7 is an exploded perspective view of another configuration for the quiver assembly of FIG. 1.

The hood end cap 54 may have a pair of connector apertures 66 similar to the connector aperture 64 (see FIG. 7). The hood end cap 54 may provide an end surface or partial enclosure of the first hood portion 50 when the second hood portion 52 is removed from use. A fastener 68 may be used to more securely fix the second hood portion 52 or hood end cap 54 to the first hood portion 50. In some arrangements, a plurality of fasteners 68 may be used. The fastener 68 may be used in some arrangements in place of the connector member 60 and connector aperture 64, 66.

The hood assembly 34 may comprise any suitable polymer material known to those skilled in the art. In some arrangements, the hood assembly 34 comprises composite materials or a combination of composite and polymer materials. Typically, the hood assembly 34 comprises materials having lightweight properties and strength sufficient to withstand inadvertent contact with the arrow points held therein.

The hood assembly 34 may define a generally hollow cavity (see FIG. 5) for positioning of arrow points of arrows carried by the quiver assembly 12. In some arrangements, the hood assembly 34 may include cushioning material (not shown) within the first and second arrow point cavities 58, 62. The cushioning material may help hold one end of each of the arrows spaced apart from each other. The cushioning material may help limit or dissipate vibrations in the arrows.

The first arrow mounting assembly 36 is mounted to the second end 42 of the base member 30. The first arrow mounting assembly 36 may be spaced a maximum distance from the hood assembly 34 by being mounted to an end surface of the base member 30. The first arrow mounting assembly 36 is typically mounted to the base member 30 at an axially space apart location from the second arrow mounting assembly 38. The first and second arrow mounting assemblies 36, 38 may have substantially similar constructions and have the capacity to hold substantially the same number of arrows. For example, the first and second arrow mounting assemblies 36, 38 shown in the figures may hold a maximum of up to five arrows. The first and second arrow mounting assemblies 36, 38 may be modular in nature and have a first configuration that holds up to three arrows, and a second, enlarged configuration that holds up to five arrows.

The first and second arrow mounting assemblies 36, 38 include a base mounting bracket 70, 90, a first arrow mounting portion 72, 92, and a second arrow mounting portion 74, 94. The first arrow mounting portion 72, 92 includes a first bracket 76, 96, a first resilient arrow retaining member 78, 98, and a first set of arrow seats 80, 100. The base mounting bracket 70, 90 mounts the first arrow mounting portion 72, 92 to the base member 30. The base mounting bracket 70 may include a stop surface that contacts an end surface of the base member 30 to position the first arrow mounting portion 72 directly adjacent to the second end 42 of the base member 30.

The first resilient arrow retaining member 78, 98 may mount to the first bracket 76, 96. The first bracket 76, 96 is connected to the base mounting bracket 70, 90. The first resilient arrow retaining member 78, 98 may define a plurality of first arrow seats 80, 100 that are each sized to releasably mount one of arrows 150*a-c* (see FIGS. 8-9). The first resilient arrow retaining member 78, 98 may include a plurality of arms, cushion members and entrance openings into the first arrow seats 80, 100 that provide lateral insertion of the arrows 150*a-c* into and out of the first arrow seats 80, 100. In one example, the first resilient arrow retaining member 78, 98 define three first arrow seats 80, 100. Other configurations are possible including a configuration with one, two, or four or more first arrow seats.

The second arrow mounting portion 74, 94 may comprise a second bracket 82, 102, a second resilient arrow retaining member 84, 104, an attachment extension 86, 106, and second arrow seats 88, 108. The second arrow seats are each sized to releasably mount one of arrows 150*d-e* (see FIG. 8). The second resilient arrow retaining member 84, 104 may mount to the second bracket 82, 102. The attachment extension 86, 106 may be connected to the first bracket 76, 96 of the first arrow mounting portion 72, 92.

The second resilient arrow retaining member 84, 104 may have any desired size and shape, and provide any desired number of second arrow seats 88, 108. The figures illustrate second resilient arrow retaining member 84, 104 defining two second arrow seats 88, 108 sized to releasably mount two arrows 150*d-e*. The arrows 150*d-e* may be laterally inserted into the second arrow seats 88, 108. The second resilient arrow retaining member 84, 104 may include a plurality of arms, cushion members and entrance openings to releasably hold the arrows in the second arrow seats 88, 108.

The second resilient arrow retaining member 84, 104 may have other configurations to hold different numbers of arrows. For example, the second resilient arrow retaining member 84, 104 may be configured to hold only a single arrow and define a single second arrow seat 88, 108, or may provide mounting of three or more arrows in three or more second arrow seats 88, 108.

The first and second resilient arrow retaining members 78, 98 and 84, 104 may comprise a resilient rubber or polyurethane material known to those skilled in the art. Typically, the first and second arrow mounting portion 72, 92 and 74, 94 are secured together using a plurality of fasteners such as screws. Fasteners may also be used to secure the base mounting bracket 70, 90 and first arrow mounting portion 72, 92 to the base member 30.

In some configurations, the quiver assembly includes one or the other of the first and second arrow mounting assemblies 36, 38. For example, the first and second resilient arrow retaining member 78, 84 of the first arrow mounting assembly 36 may be configured (e.g., include sufficient surface area within the first and second arrow seats 80, 88) to hold arrows in an upright, spaced apart orientation that limits contact between the arrow points positioned within the hood assembly 34 without the use the second arrow mounting assembly 38. In other examples, three or more arrow mounting assemblies may be used to mount the arrows. The arrow mounting assemblies may be mounted on a single base member 30 or on separate base members. The separate base members may be separately secured to the riser 14.

The quiver assemblies shown with reference to FIGS. 1-9 may be used independent of an archery bow (e.g., disconnected from a riser of an archery bow). For example, a quiver assembly sized to carry a maximum of five arrows may carry up to the maximum number of five arrows and be used to, for example, store the arrows for long term storage, carry extra arrows during use of one or more archery bows (e.g., for use in a target practice session), or organize or display the arrows.

One method of the present disclosure relates to mounting variable numbers of arrows to an archery bow. The method may include providing an arrow quiver that includes a modular arrow mounting assembly having first and second arrow attachment portions. The first arrow attachment portion is mounted to the archery bow using an attachment assembly. The first arrow attachment portion is configured to mount a first maximum number of arrows to the archery bow. If the user desires to mount a number of arrows to the archery bow that exceeds the first maximum number of arrows, a second arrow attachment portion may be mounted to the first arrow attachment portion. The second arrow attachment portion increases the capacity of the arrow quiver to hold a second maximum number of arrows that is greater than the first maximum number of arrows.

The quiver may also include a hood assembly arranged to at least partially hood arrow points of the arrows held by the quiver. The hood assembly may also be modular in nature. The hood assembly may include first and second hood portions. The first hood portion may be sized to hood only the arrow points of the first maximum number of arrows. Adding the second hood portion to the first hood portion increases the capacity of the hood assembly to hold up to the second maximum number of arrows held by the quiver after mounting the second arrow attachment portion to the first arrow attachment portion. A hood end cap may be secured to the first hood portion in place of the second hood portion when the second hood portion is not in use.

It should be noted that for purposes of this disclosure, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature.

The terms recited in the claims should be given their ordinary and customary meaning as determined by reference to relevant entries (e.g., definition of "plane" as a carpenter's tool would not be relevant to the use of the term "plane" when used to refer to an airplane, etc.) in dictionaries (e.g., widely used general reference dictionaries and/or relevant technical dictionaries), commonly understood meanings by those in the art, etc., with the understanding that the broadest meaning imparted by any one or combination of these sources should be given to the claim terms (e.g., two or more relevant dictionary entries should be combined to provide the broadest meaning of the combination of entries, etc.) subject only to the following exceptions: (a) if a term is used herein in a manner more expansive than its ordinary and customary meaning, the term should be given its ordinary and customary meaning plus the additional expansive meaning, or (b) if a term has been explicitly defined to have a different meaning by reciting the term followed by the phrase "as used herein shall mean" or similar language (e.g., "herein this term means," "as defined herein," "for the purposes of this disclosure [the term] shall mean," etc.). References to specific examples, use of "i.e.," use of the word "invention," etc., are not meant to invoke exception (b) or otherwise restrict the scope of the recited claim terms. Other than situations where exception (b) applies, nothing contained herein should be considered a disclaimer or disavowal of claim scope. Accordingly, the subject matter recited in the claims is not coextensive with and should not be interpreted to be coextensive with any particular embodiment, feature, or combination of features shown herein. This is true even if only a single embodiment of the particular feature or combination of features is illustrated and described herein. Thus, the appended claims should be read to be given their broadest interpretation in view of the prior art and the ordinary meaning of the claim terms.

As used herein, spatial or directional terms, such as "left," "right," "front," "back," and the like, relate to the subject matter as it is shown in the drawing figures. However, it is to be understood that the subject matter described herein may assume various alternative orientations and, accordingly, such terms are not to be considered as limiting. Furthermore, as used herein (i.e., in the claims and the specification), articles such as "the," "a," and "an" can connote the singular or plural. Also, as used herein, the word "or" when used without a preceding "either" (or other similar language indicating that "or" is unequivocally meant to be exclusive—e.g., only one of x or y, etc.) shall be interpreted to be inclusive (e.g., "x or y" means one or both x or y). Likewise, as used herein, the term "and/or" shall also be interpreted to be inclusive (e.g., "x and/or y" means one or both x or y). In situations where "and/or" or "or" are used as a conjunction for a group of three or more items, the group should be interpreted to include one item alone, all of the items together, or any combination or number of the items. Moreover, terms used in the specification and claims such as have, having, include, and including should be construed to be synonymous with the terms comprise and comprising.

Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. An arrow quiver, comprising:

a base member;

a bow attachment member configured to mount the base member to an archery bow;

at least one arrow mounting assembly, comprising:

a first arrow mounting portion mounted to the base member and configured to retain a first plurality of arrows;

a second arrow mounting portion releasably mounted to the first arrow mounting portion and configured to retain a second plurality of arrows.

2. The arrow quiver of claim 1 wherein the first arrow mounting portion retains at least three arrows, and the second arrow mounting portion retains at least two arrows.

3. The arrow quiver of claim 1 further comprising first and second arrow mounting assemblies separately mounted to the base member and that each comprise:

a first arrow mounting portion mounted to the base member and configured to retain a first plurality of arrows;

a second arrow mounting portion releasably mounted to the first arrow mounting portion and configured to retain a second plurality of arrows.

4. The arrow quiver of claim 1 further comprising a hood assembly mounted to the base member and configured to at least partially hood arrow points of the plurality of arrows retained by the at least one arrow mounting assembly.

5. The arrow quiver of claim 4 wherein the hood assembly comprises:

a first hood portion mounted to the base member and configured to at least partially house the arrow points of the first plurality of arrows;

a second hood portion releasably mounted to the first hood portion and configured to at least partially house the arrow points of the second plurality of arrows.

6. The arrow quiver of claim 5 further comprising a hood end cap mountable to the first hood portion in place of the second hood portion.

7. The arrow quiver of claim 5 wherein the first and second hood portions connect together with a sliding lock.

8. The arrow quiver of claim 4 wherein the base member includes an elongate shaft, the hood assembly being mounted to a first end of the elongate shaft, and the at least one arrow mounting assembly being mounted to a second end of the elongate shaft.

9. The arrow quiver of claim 8 wherein the bow attachment member is mounted to the elongate shaft at a location spaced between the at least one arrow mounting assembly and the hood assembly.

10. The arrow quiver of claim 1 wherein the second arrow mounting portion includes at least one resilient arrow retaining member and an attachment extension, the attachment extension being configured to connect the second arrow mounting portion to the first arrow mounting portion.

11. An arrow quiver, comprising:

at least one arrow mounting assembly having a first configuration for holding a first maximum number of arrows, and a second configuration for holding a second maximum number of arrows;

a base portion configured to releasably mount the at least one arrow mounting assembly to an archery bow;

further comprising a hood assembly configured to house end portions of arrows held by the at least one arrow mounting assembly, the hood assembly having a first configuration for housing a first maximum number of arrow end portions of the first maximum number of arrows, and a second configuration for housing a second maximum number of arrow end portions of the second maximum number of arrows.

12. An arrow quiver, comprising:

at least one arrow mounting assembly having a first configuration for holding a first maximum number of arrows, and a second configuration for holding a second maximum number of arrows;

a base portion configured to releasably mount the at least one arrow mounting assembly to an archery bow;

wherein the at least one arrow mounting assembly includes first and second arrow mounting assemblies that each include a first configuration for holding a first maximum number of arrows, and a second configuration for holding a second maximum number of arrows.

13. A method of mounting arrows to an archery bow, comprising:

providing an arrow quiver that includes at least one arrow mounting assembly including first and second arrow attachment portions each configured to retain a plurality of arrows;

mounting the at least one arrow mounting assembly to the archery bow;

mounting a first plurality of arrows to the first arrow attachment portion;

mounting the second arrow attachment portion to the first arrow attachment portion;

mounting a second plurality of arrows to the second arrow attachment portion.

14. The method of claim 13, wherein each of the first plurality of arrows is individually mounted to the first arrow attachment portion, and each of the second plurality of arrows is individually mounted to the second arrow attachment portion.

15. The method of claim 13, further comprising providing a hood assembly that includes first and second hood portions releasably connected together, the first hood portion being sized to hood arrow points of the first plurality of arrows, and the second hood portion being sized to hood arrow points of the second plurality of arrows.

16. The method of claim 15, wherein the hood assembly further includes a hood end cap releasably connected to the first hood portion in place of the second hood portion.

17. The method of claim 13, wherein each of the first and second arrow attachment portions includes a plurality of resilient arrow retaining members configured to individually mount at least one arrow.

18. The method of claim 13, further comprising providing a base member and an attachment assembly, the method including connecting the at least one arrow mounting assembly to the base member, and mounting the base member to the archery bow with the attachment assembly.

* * * * *